US011786015B2

(12) United States Patent
Pontaoe et al.

(10) Patent No.: US 11,786,015 B2
(45) Date of Patent: Oct. 17, 2023

(54) SAFETY RELEASE BUCKLE

(71) Applicant: Illinois Tool Works Inc., Glenview, IL (US)

(72) Inventors: John Pontaoe, Chicago, IL (US); Steve Keller, Island Lake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/879,493

(22) Filed: Aug. 2, 2022

(65) Prior Publication Data

US 2023/0100046 A1 Mar. 30, 2023

Related U.S. Application Data

(60) Provisional application No. 63/249,432, filed on Sep. 28, 2021.

(51) Int. Cl.
*A44B 11/25* (2006.01)

(52) U.S. Cl.
CPC ..... *A44B 11/2592* (2013.01)

(58) Field of Classification Search
CPC ..... A44B 11/2592; A44B 11/2569
See application file for complete search history.

(56) References Cited

U.S. PATENT DOCUMENTS 4,631,787 A 12/1986 Kasai
4,639,982 A 2/1987 Kasai
5,027,481 A 7/1991 Frano
5,203,058 A 4/1993 Krauss
D341,105 S 11/1993 Attilio
D349,262 S 8/1994 Krauss
D373,747 S 9/1996 Anscher
5,791,026 A * 8/1998 Anscher ..... A44B 11/266 24/615

(Continued)

FOREIGN PATENT DOCUMENTS

EP 1400183 3/2004

OTHER PUBLICATIONS

X-Stealth Side-Release Buckle, No Date Available, Ortlieb, Site Visited on Feb. 17, 2023: https://www.ortlieb.com/en_us/side-release-buckle-stealth-25mm (Year: 2023).

(Continued)

*Primary Examiner* — Robert Sandy
(74) *Attorney, Agent, or Firm* — McAndrews, Held & Malloy, Ltd.

(57) ABSTRACT

A buckle assembly that includes a male buckle component to mate with a female buckle component into a securely connected position. The male buckle component includes a main body, a mating guide beam, and one or more lateral arms coupled to the main body to deflect about a pivot point. Each of the one or more lateral arms includes a flexible lateral arm and a button. The button engages the female buckle component via a latching ledge, which defines a sloped transition from the flexible lateral arm to the button. The female buckle component includes a housing that defines a button aperture to secure the button of the male component, a disengagement aperture proximal to the button aperture, and a pocket to receive the male buckle component.

20 Claims, 7 Drawing Sheets

(56) References Cited

U.S. PATENT DOCUMENTS

| | | | | |
|---|---|---|---|---|
| 5,794,316 | A * | 8/1998 | Anscher | A44B 11/266 24/615 |
| D405,726 | S | 2/1999 | Krauss | |
| 6,226,844 | B1 | 5/2001 | Lerra | |
| 6,247,213 | B1 * | 6/2001 | Uehara | A44B 11/266 24/625 |
| 6,460,232 | B2 * | 10/2002 | Maruoka | A44B 11/266 24/615 |
| 6,615,460 | B1 | 9/2003 | Baumgarten | |
| 7,089,633 | B2 | 8/2006 | Liu | |
| 7,111,368 | B2 | 9/2006 | Matoba | |
| 7,140,082 | B2 | 11/2006 | Chen | |
| D535,912 | S | 1/2007 | Pontaoe | |
| D536,279 | S | 2/2007 | Grimm | |
| 7,302,742 | B2 | 12/2007 | Pontaoe | |
| D576,521 | S | 9/2008 | Kolasa | |
| 7,979,966 | B2 | 7/2011 | Yoshie | |
| 8,256,072 | B2 | 9/2012 | Kolasa | |
| 8,286,311 | B2 * | 10/2012 | Paik | A44B 11/266 24/615 |
| 8,572,820 | B2 | 11/2013 | Richards | |
| 8,601,652 | B2 | 12/2013 | Uehara | |
| 9,655,412 | B2 | 5/2017 | Nanbu | |
| 9,750,310 | B2 | 9/2017 | Kolasa | |
| 11,185,131 | B1 * | 11/2021 | Lin | A44B 11/266 |
| D945,313 | S | 3/2022 | Millward | |
| 11,259,604 | B2 | 3/2022 | Kolasa | |
| 2007/0017074 | A1 | 1/2007 | Pontaoe | |
| 2008/0134479 | A1 | 6/2008 | Kolasa | |
| 2011/0219590 | A1 | 9/2011 | Anscher | |
| 2013/0232743 | A1 | 9/2013 | Takazakura | |
| 2020/0205528 | A1 * | 7/2020 | Yoshie | A44B 11/266 |

OTHER PUBLICATIONS

The extended European search report for Application No. 21179512.5 dated Nov. 4, 2021, European Patent Office, Germany (9 pages).

* cited by examiner

SAFETY RELEASE BUCKLE

CROSS-REFERENCE

The present application claims the benefit under 35 U.S.C. § 119(e) of U.S. Provisional Patent Application Ser. No. 63/249,432, filed Sep. 28, 2021 and titled "Safety Release Buckle," the contents of which are hereby incorporated by reference.

FIELD

The present disclosure generally relates to a buckle assembly, and more particularly to a side-release buckle assembly.

BACKGROUND

A conventional side-release buckle assembly includes a male buckle component that is configured to mate with a female buckle component, such as shown and described in commonly-owned U.S. Pat. No. 7,302,742, entitled "Side-release Buckle Assembly," and U.S. Pat. No. 8,256,072, entitled "Buckle." Each of the male buckle component and the female buckle component of the buckle is configured to retain a lead. The male buckle component includes integral buttons that may be engaged to release the male buckle component from the female buckle component, thereby disconnecting the buckle assembly.

SUMMARY

The present disclosure relates generally to a buckle assembly, and more particularly to a side-release buckle assembly, substantially as illustrated by and described in connection with at least one of the figures, as set forth more completely in the claims.

DRAWINGS

The foregoing and other objects, features, and advantages of the devices, systems, and methods described herein will be apparent from the following description of particular examples thereof, as illustrated in the accompanying figures; where like or similar reference numbers refer to like or similar structures. The figures are not necessarily to scale, emphasis instead being placed upon illustrating the principles of the devices, systems, and methods described herein.

DESCRIPTION

Figure 1A:
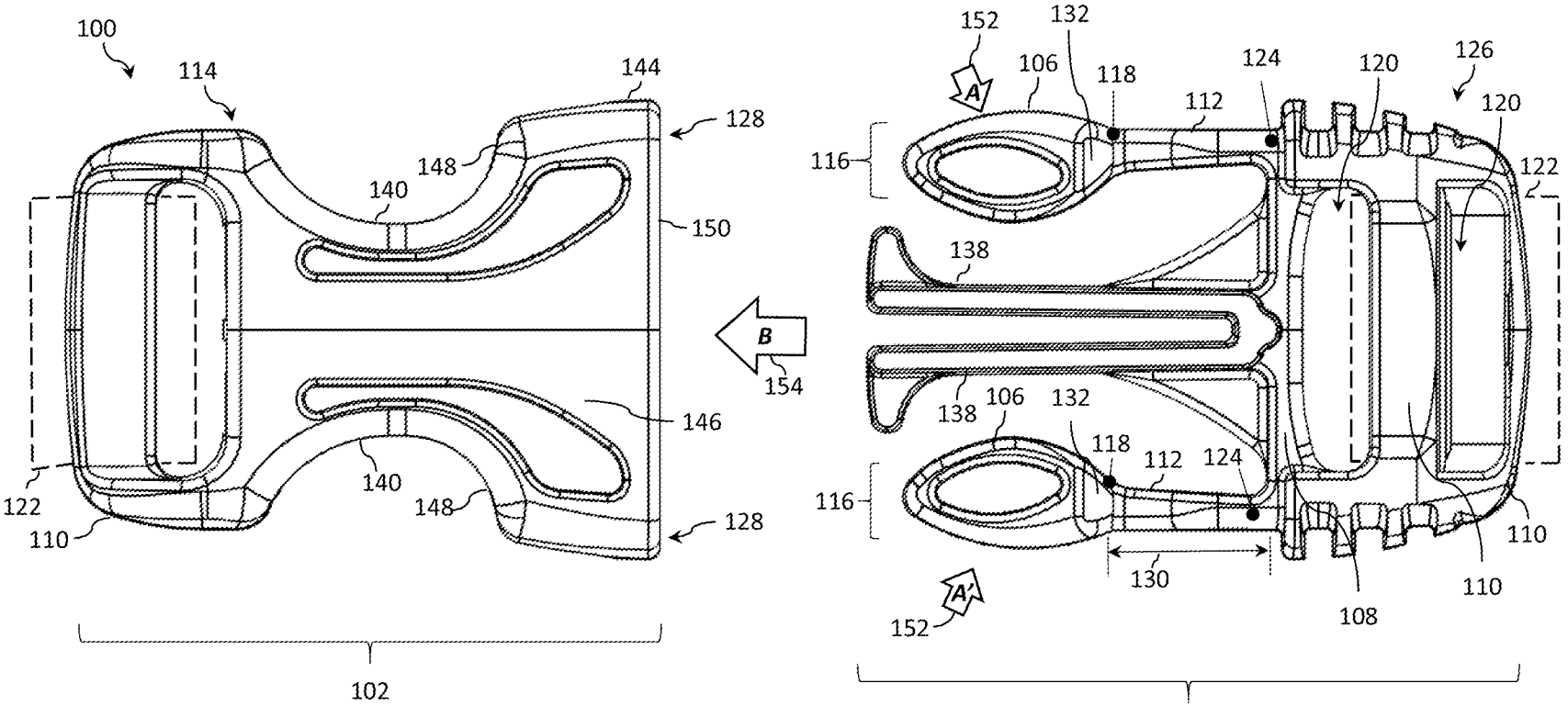
FIGS. 1A and 1B illustrate, respectively, top plan views of disconnected and connected buckle assemblies in accordance with aspects of this disclosure.

References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Recitation of ranges of values herein are not intended to be limiting, referring instead individually to any and all values falling within and/or including the range, unless otherwise indicated herein, and each separate value within such a range is incorporated into the specification as if it were individually recited herein. In the following description, it is understood that terms such as "first," "second," "top," "bottom," "side," "front," "back," and the like are words of convenience and are not to be construed as limiting terms. For example, while in some examples a first side is located adjacent or near a second side, the terms "first side" and "second side" do not imply any specific order in which the sides are ordered.

The terms "about," "approximately," "substantially," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the disclosure. The use of any and all examples, or exemplary language ("e.g.," "such as," or the like) provided herein, is intended merely to better illuminate the disclosed examples and does not pose a limitation on the scope of the disclosure. The terms "e.g.," and "for example" set off lists of one or more non-limiting examples, instances, or illustrations. No language in the specification should be construed as indicating any unclaimed element as essential to the practice of the disclosed examples.

The term "and/or" means any one or more of the items in the list joined by "and/or." As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y, and/or z" means "one or more of x, y, and z."

A buckle assembly can be used to join two or more components, such as a lead (e.g., straps, ropes, strips, cordage, or another material to be fastened). Such buckles may have various uses in different applications. For example, a buckle assembly may be used on bags, safety gear (e.g., such as helmets), collars, or any other application that may need to be fastened. The buckle assembly herein will be described below in reference to use on a lead of a safety helmet, such as a hard hat. However, the buckle assembly disclosed herein is not limited to that application.

In some examples, buckles for use on safety helmets may have to comply with certain safety standards. Such safety standards may define a minimum force that the buckle assembly can withstand as well as a maximum force the buckle can withstand. These safety standards may help ensure that the safety device offers adequate protection, but that the safety device itself does not pose a risk to the person wearing it. For example, the minimum force a buckle can withstand may ensure that the buckle remains intact and connected such that the safety helmet remains on the wearer. On the other hand, a buckle on a safety helmet needs to be able to disconnect or break at higher force loads so that the buckle (connecting the leads of the helmet) does not pose a risk of strangulation to the wearer. In this way, conventional buckles for use on safety helmets may be configured to break, thereby disconnecting the leads of the helmet, at a maximum force. In turn, once the conventional buckle reaches the maximum force and breaks to disconnect, the buckle will need to be fully replaced. In other words, an incident resulting in the maximum force upon the buckle assembly ends the useful life a traditional buckle. This results in increased costs and time to replace the buckle assemblies on the safety helmets. In other examples, a traditional buckle may be configured to disconnect without breaking upon reaching a maximum force, but may still have a limited useful life. For instance, such a traditional buckle may only be able to be used a finite number of times. As one example, a conventional buckle may only be able to withstand reaching such a high load ten or fewer times before needing to be replaced. Thus, even if a traditional buckle can be disconnected rather than breaking at a high force, such a buckle may still require increased costs and time to replace the buckle assemblies.

The buckle disclosed herein is designed to meet the appropriate safety standards (e.g., withstanding a minimum load and disconnecting upon a maximum load), but does not break when the maximum load is applied to the buckle. Instead, the buckle disclosed herein is configured to disconnect upon application of the maximum force. In this way, the buckle disclosed herein does not break and is reusable even after application of a high load. Thus, the buckle disclosed herein may result in decreased costs of replacement, increase the useful life of the buckle, and save time (e.g., due to the buckles not needing to be replaced).

In some aspects, a buckle assembly includes a male buckle component configured to mate with a female buckle component into a securely connected position. The male buckle component may include a main body, a mating guide beam, and one or more lateral arms coupled to the main body and configured to deflect about a pivot point. Each of the one or more lateral arms may include a flexible lateral arm and a button. The button may be configured to engage the female buckle component via a latching ledge, and the latching ledge may define a sloped transition from the flexible lateral arm to the button. The female buckle component may include a housing that defines a button aperture configured to secure the button of the male component, a disengagement aperture proximal to the button aperture, and a pocket configured to receive the male buckle component.

Figure 1B:
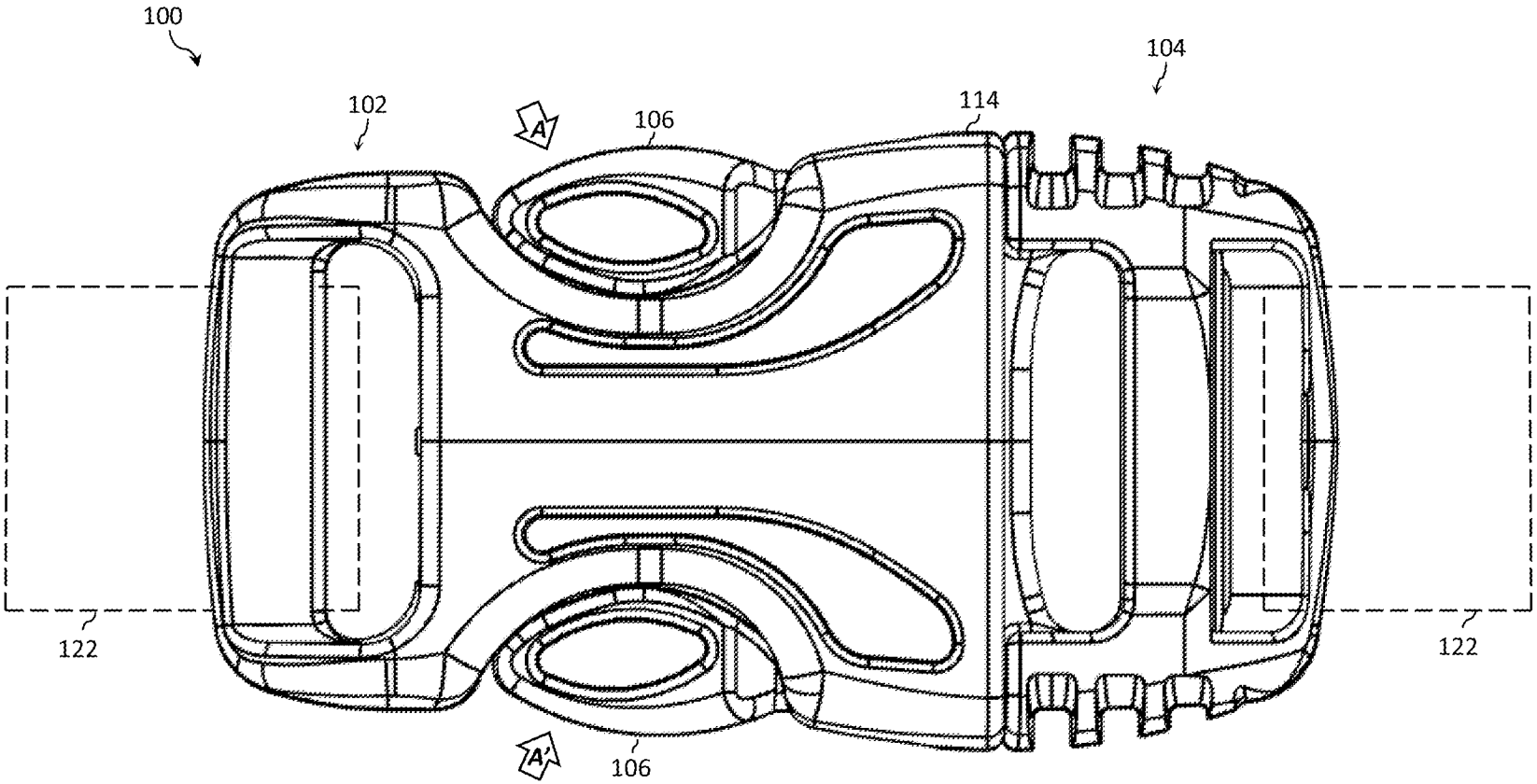

FIG. 1A illustrates a top plan view of a disconnected buckle assembly 100, while FIG. 1B illustrates a top plan view of a connected buckle assembly 100. As illustrated, the buckle assembly 100 is configured as a side-release buckle assembly that includes a male buckle component 104 and a female buckle component 102. In operation, the pair of lateral arm members 116 is inserted into and received by a pocket 128 of female buckle component 102 to latch the buckle assembly 100. The pair of lateral arm members 116 is inserted via an insertion force 154, which is indicated by Arrow B. The buckle assembly 100 is released or disconnected by providing compression forces 152 inwardly from the side as indicated by Arrows A and A'. The male buckle component 104 and the female buckle component 102 can be made as individual monolithic structures of plastic formed by injection molding processes, engineered plastic, moldable plastic, computer numerical control (CNC) machining, or the like.

Leads 122 can be attached to each of the male buckle component 104 and the female buckle component 102 so that buckle assembly 100 can be used to secure together opposite ends of a single lead 122 or to secure ends of separate leads 122. Example leads 122 include, inter alia, straps (e.g., backpack straps, belts, etc.), ropes, strips, cordage, or another material to be fastened. The leads 122 may be fabricated from, for example, plastic, nylon, leather, fabric, etc. In some examples, each of the male buckle component 104 and the female buckle component 102 may be adjustably positioned along the length of a lead 122. Other structures or components, however, may be used to couple to the male buckle component 104 and/or the female buckle component 102 in addition to, or in lieu of, the leads 122. For example, the male buckle component 104 and/or the female buckle component 102 may be coupled to an item (e.g., bag, belt, garment, etc.) via mechanical fasteners (e.g., snaps, rivets, carabiner clips, etc.), adhesives, etc.

In order to securely mate the male buckle component 104 into the female buckle component 102, the male buckle component 104 is urged into the female buckle component 102 via insertion force 154. The female buckle component 102 defines a receiving body or pocket 128. In some examples, the female buckle component 102 includes a housing 114 formed as a set of plates spaced apart and secured at the edges via the sides 144 to form a pocket-like structure to define the pocket 128. The sides 144 of the housing 114 are shaped to define button apertures 140 (e.g., apertures in the sides 144). The button apertures 140 are sized and positioned to receive buttons 106 when the male buckle component 104 is fully inserted into the pocket 128 of the female buckle component 102. The pocket 128 may further define one or more channels to define a guide way to direct male buckle component 104 straight into female buckle component 102 from an entrance opening 150 to the pocket 128. The one or more channels may be formed on, for example, in interior surface of the set of plates 146. The one or more channels may be configured to guide the male buckle component 104 via a mating guide beam 138 that outwardly extends from a rigid strut member. For example, using insertion force 154 as indicated by Arrow B, the mating guide beam 138 passes into a mating channel or sleeve formed in the female buckle component 102 in order to assure proper mating alignment. Once the buttons 106 are snapably secured into the button apertures 140 formed in the female buckle component 102, the male buckle component 104 is securely retained within the female buckle component 102.

The male buckle component 104 includes a pair of lateral arm members 116. While the pair of lateral arm members 116 are illustrated as generally parallel one another, they may be non-parallel. Each of the lateral arm members 116 includes a flexible lateral arm 112 with a button 106 at a distal end 118 thereof. As illustrated, the flexible lateral arms 112 are spaced apart and generally parallel to one another. In some examples, the flexible lateral arm 112 and the buttons 106 are fabricated as a unitary structure. In some examples, the flexible lateral arm 112 and the buttons 106 are distinct components. For example, the buttons 106 may be a solid, rigid button coupled to an end of the flexible lateral arm 112. In other examples, the flexible lateral arm 112 may be configured to form a non-linear portion that defines, or otherwise serves as, the button 106. For example, the flexible lateral arm 112 may be shaped to define the button 106. In either arrangement, the buttons 106 define a latching ledge 132 configured to engage the female buckle component 102. For example, the latching ledge 132 may engage a lock ledge 148 defined by the housing 114 of the female buckle component 102.

In some examples, a rigid strut member 108 extends between the lateral arm members 116. The rigid strut member 108 is generally perpendicular to the lateral arm members 116. A lead-receiving channel 120 is formed through the male buckle component 104 between, for example, the rigid strut member 108 and a lead bar 110. In some examples, such as the example illustrated in FIG. 1A, the male component 104 may include two or more lead bars 110. In such cases, a lead-receiving channel 120 may be formed between each of the two or more lead bars 110 and/or between the rigid strut member 108 and at least one of the lead bars 110. In some examples, the rigid strut member 108 and the lead bars 110 are parallel to one another. The lead-receiving channel 120 is configured to secure the lead 122.

The lateral arm members 116 are integrally connected to the main body 126 at pivot points 124 (e.g., via one of the rigid strut members 108). The lateral arm members 116 are configured to pivot (e.g., flex) in the direction of Arrows A and A' about pivot points 124 defined by the union of the rigid strut member 108 and the lateral arm members 116. In other words, the lateral arm members 116 are rigidly coupled at pivot points 124 and configured to flex inwardly along their lengths (e.g., their effective lengths 130) in the direction of Arrows A and A'.

In general, the rigid strut member 108 is disposed between the pivot points 124 and adjacent the lead-receiving channel 120. In one example, the pivot points 124 are distally located from the lead bar 110 and the rigid strut member 108. As shown in FIG. 1A, a rigid strut member 108 extends between the lateral arm members 116 and is integrally connected with the lead bar 110 to form a main body 126 of the male buckle component 104. Thus, the rigid strut member 108 is inflexible. While the main body 126 is illustrated with a rigid strut member 108, the rigid strut member 108 may be omitted and the lateral arm members 116 can be integrally connected to the main body 126 at another location. For example, the lateral arm members 116 can be connected at the lead bar 110.

In operation, the pair of lateral arm members 116 is inserted into and received by pocket 128 of female buckle component 102 as indicated by Arrow B to connect the buckle assembly 100. In order to secure the male buckle component 104 into the female buckle component 102, the male buckle component 104 is urged into the female buckle component 102 in the direction of Arrow B. The mating guide beam 138 of the male buckle component 104 moves into a reciprocal channel formed in the pocket 128 of the female buckle component 102 to ensure proper mating alignment between the female and male buckle components 102 and 104, respectively.

As the male buckle component 104 is urged into the female buckle component 102, the lateral arm members 116 deflect inwardly (e.g., deformed or flexed) in the directions of Arrows A and A' until the buttons 106 reach button apertures 140 formed by the female buckle component 102. To that end, the flexible lateral arm 112 is configured to flex along its effective length 130 between the pivot point 124 and a latching ledge 132 at its distal end 118. For purposes of this disclosure, the effective length 130 refers to the length along the flexible lateral arm 112 to enable the flexible lateral arm 112 to flex between the pivot point 124 and the distal latching ledge 132 during connecting and disconnecting of the buckle assembly 100. The effective length 130 is a function of the shape of the flexible lateral arm 112. In the example of FIGS. 1A and 1B, the flexible lateral arms 112 are generally linear (e.g., straight) with a rigid button 106 coupled at the distal end 118 that defines the latching ledge 132.

When the buttons 106 enter the button apertures 140 in response to the insertion force 154, the tension stored in the lateral arm members 116 (via the flexible lateral arm 112) biases the buttons 106 laterally outward (e.g., in directions opposite that of Arrows A and A') such that the buttons 106 are secured within the button apertures 140. At this point, the male buckle component 104 is secured to the female buckle component 102.

FIG. 1B illustrates a top plan view of the buckle assembly 100 in which the male buckle component 104 is securely mated into the female buckle component 102. In order to disconnect the male buckle component 104 from the female buckle component 102, the buttons 106 are squeezed inwardly (e.g., from the sides) toward one another in the direction of Arrows A and A'.

As discussed above, the buckle assembly 100 disclosed herein meets appropriate safety standards (e.g., withstanding a minimum load and disconnecting upon a maximum load) without breaking when the maximum load is applied to the buckle. In order for the buckle assembly 100 to disconnect under the maximum force without a user having to push buttons 106 inward to disconnect the female component 102 from the male component 104, the female component 102 includes disengagement apertures in addition to the button apertures 140.

Figure 2A:
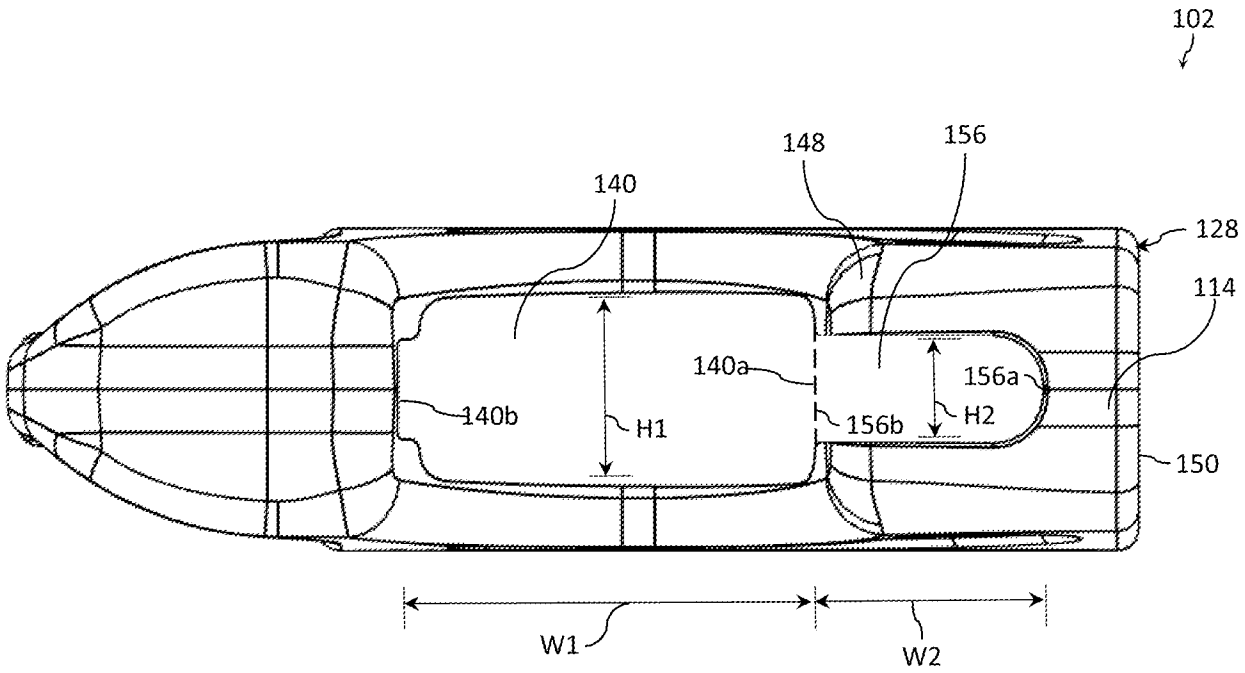
FIG. 2A illustrates a disconnected buckle assembly with a female buckle component in accordance with aspects of this disclosure.
Figure 2B:
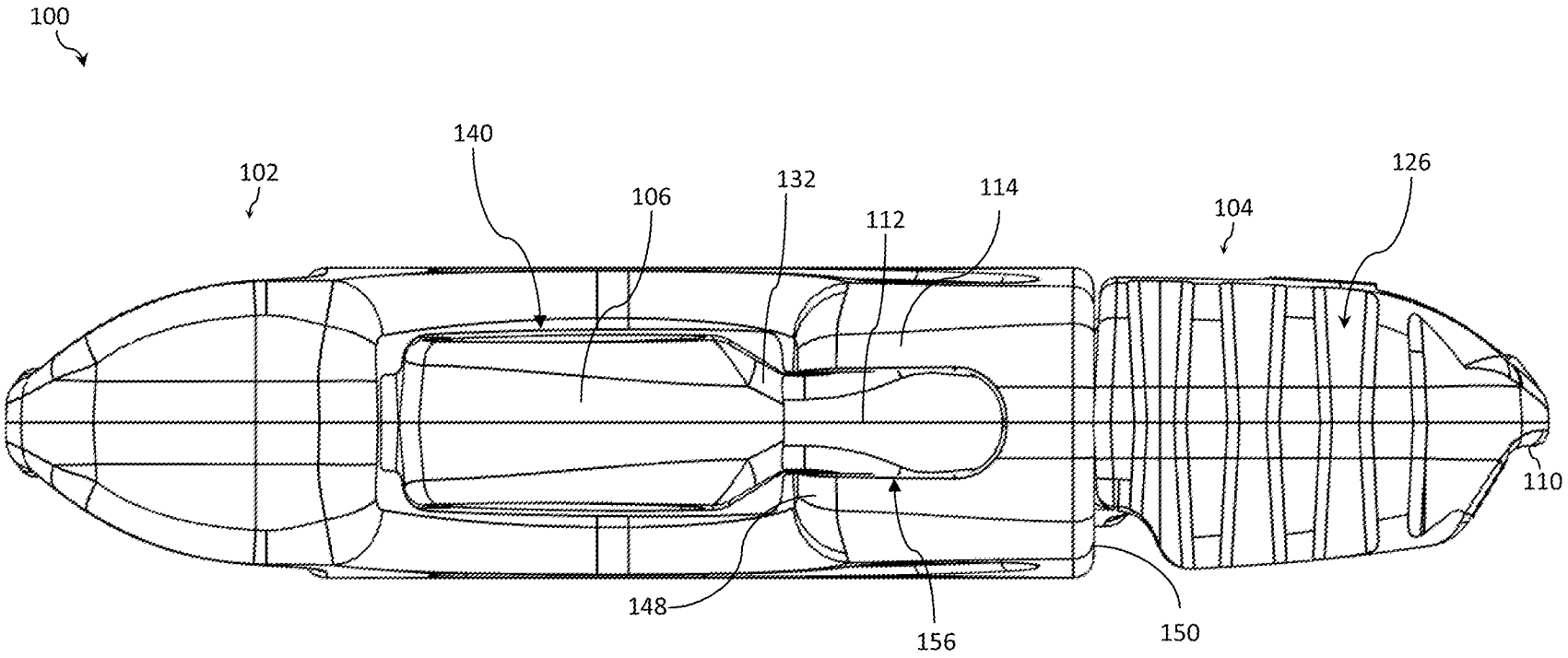
FIG. 2B illustrates a connected buckle assembly with the female buckle component of FIG. 2A and a male buckle component in accordance with aspects of this disclosure.

FIG. 2A illustrates a disconnected buckle assembly with a female buckle component 102 including disengagement apertures 156 in accordance with aspects of this disclosure. FIGS. 2A and 2B are described with respect to a single button aperture 140 and a single disengagement aperture 156. It should be noted that the following description of the button aperture 140 and the disengagement aperture 156 applies to the buckle assembly 100 as a whole, including a button aperture 140 and a disengagement aperture 156 on each side of the female component 102 (e.g., the buckle assembly 100 having two button apertures 140 and two disengagement apertures 156). The button aperture 140 may be the same or substantially the same as described with respect to FIGS. 1A and 1B. The button aperture 140 may be any suitable shape such that button 106 of the male component 104 can be snapably secured within button aperture 140. For example, the button aperture 140 may have a shape that substantially corresponds to the shape of the button 106 of the male component 104.

As shown in FIG. 2A, the button aperture 140 may define a first width W1 (e.g., as measured in the direction of the length of the female component 102 from a first proximal end 140*a* of the button aperture 140 to a first distal end 140*b* of the button aperture 140). In some examples, the first width W1 may be measured at the widest cross-section of button aperture 140 (e.g., as measured in the direction of the length of the female component 102). The button aperture 140 may also define a first height H1 (e.g., as measured in a direction generally perpendicular to the first width W1). In some examples, the first height H1 may be measured at the longest cross-section of button aperture 140 (e.g., as measured in a direction generally perpendicular to the first width W1).

In some examples, the housing 114 of the female component 102 includes one or more lock ledges 148 to interface with the male buckle component 104. For example, the housing 114 may define the lock ledge 148 at or near the proximal end 140*a* of the button aperture 140. In other examples, the lock ledge 148 may be located on a different part of the housing 114.

The female component 102 also includes a disengagement aperture 156. Similar to the button aperture 140, the disengagement aperture 156 may define a second width W2 (e.g., as measured in the direction of the length of the female component 102 from a second proximal end 156*a* of the disengagement aperture 156 to a second distal end 156*b* of the disengagement aperture 156). In some examples, the second width W2 may be measured at the widest cross-section of disengagement aperture 156 (e.g., as measured in the direction of the length of the female component 102). The disengagement aperture 156 may also define a second height H2 (e.g., as measured in a direction generally perpendicular to the second width W2). In some examples, the second height H2 may be measured at the longest cross-section of disengagement aperture 156 (e.g., as measured in a direction generally perpendicular to the second width W2).

In some examples, the first height H1 of the button aperture 140 may be larger than the second height H2 of the disengagement aperture 156. Such a configuration may enable the button 106 to be urged into the button aperture 140 without becoming engaged in the disengagement aperture 156. In other words, the second height H2 of disengagement aperture 156 may be too small for the button 106 to become snapably secured in the disengagement opening 156. In this way, upon insertion force 154, the button 106 will not be biased laterally outward (e.g., in directions opposite that of arrows A and A') until the button 106 reaches the button aperture 140. In other examples, the first height H1 of the button aperture 140 may be the same size or smaller than the second height H2 of the disengagement aperture 156.

In some examples, the button aperture 140 and the disengagement aperture 156 may be contiguous. For example, as illustrated in FIG. 2A, the distal end 156*b* of disengagement aperture 156 may abut the proximal end 140*a* of the button aperture 140. In this way, the button aperture 140 and disengagement aperture 156 may define a single, larger aperture in the housing 114 of the female component 102. In some such examples, a center of each of the button aperture 140 and the disengagement aperture 156 may be configured to align. For example, a first center axis of button aperture 140 (e.g., that is generally perpendicular to the first height H1 and located halfway along first height H1) may substantially align with a second center axis of disengagement aperture 156 (e.g., that is generally perpendicular to the second height H2 and located halfway along second height H2). Moreover, in some examples in which the button aperture 140 and the disengagement aperture 156 are contiguous, the lock ledge 148 defined by the housing 114 may be positioned at or near the distal end 156*b* of the disengagement aperture 156 (e.g., in examples in which the lock ledge 148 is at or near the proximal end 140*a* of the button aperture 140 since the proximal end 140*a* of the button aperture 140 abuts the distal end 156*b* of the disengagement aperture 156 in the contiguous examples discussed herein).

In an example in which the button aperture 140 and the disengagement aperture 156 are contiguous, the housing 114 of the female component 102 may be more flexible than a housing 114 in which the button aperture 140 and the disengagement aperture 156 are not contiguous. In any case, however, a housing 114 having both a button aperture 140 and a disengagement aperture 156 may be more flexible than a housing having only a button aperture 140 and not having a disengagement aperture 156. Flexibility can be increased by including features as openings 158 (e.g., holes or slots) in the set of plates 146 (e.g., the top and bottom plates, as illustrated), in the side walls, etc. The increased flexibility of the housing 114 of the female component 102 having both the button aperture 140 and the disengagement aperture 156 (whether contiguous or not) may enable the female component to have a longer useful life and prevent breakage of one or both of the female component 102 or the male component 104 of the buckle assembly 100. Moreover, this increased flexibility of the housing 114 may also enable the female component 102 to expand at a lower load relative to a traditional, less flexible female component, thereby allowing the male component 104 to be disconnected from the female component 102 (without user intervention) without breaking or otherwise being damaged.

For example, a female component 102 with a button aperture 140 and a disengagement aperture 156 that are contiguous may enable the male component 104 and the female component 102 to disconnect without breaking upon application of a maximum force on the buckle assembly 100. For example, upon application of a particular force on the buckle assembly 100 (e.g., such as a maximum force set by a particular safety standard) the force upon the buckle assembly 100 may cause the female component 102 and the male component 104 to move in generally opposite directions. For instance, the force upon the buckle assembly may move the male component 104 a direction substantially opposite of the insertion force 154 (e.g., in the direction opposite of Arrow B). Upon such movement of the female component 102 and/or the male component 104, the lock ledge 148 at or near the proximal end 156*a* of the disengagement aperture 156 may exert a force on the latching ledge 132 that causes the button 106 to be biased laterally inward (e.g., in directions of arrows A and A'). This may result in the button 106 of the male component 104 expanding the female component 102 to disconnect from the female component 102 without user intervention and without one or both of the male component 104 or the female component 102 breaking. In contrast, in traditional buckle assemblies the male component may be configured to pull on the female component at an application of a particular force to cause one or both of the female or male components to break in order to unlatch the buckle assembly. Thus, the increased flexibility of the female component 102 may enable the buckle assembly 100 to remain intact rather than breaking upon application of a relative high load. Moreover, such flexibility of the female component 102 may enable the buckle assembly 100 to be reused many times, even after application of a relatively high force. For example, the buckle assembly 100 including the flexible female component 102 may enable the buckle assembly 100 to be used repeatedly even after ten or more applications of a relatively high force. In some examples, the buckle assembly 100 may be able to be reused after ten or more, twenty or more, fifty or more, or one-hundred or more applications of a relatively high force. In other examples, the buckle assembly 100 described herein may be able to be reused despite any number of applications of a relatively high force.

FIG. 2B illustrates a connected buckle assembly with the female buckle component 102 of FIG. 2A and a male buckle component 104 in accordance with aspects of this disclosure. In some examples, such as the example illustrated in FIG. 2B, the latching ledge 132 of the lateral arm member 116 may define a sloped transition from the flexible lateral arm 112 to the button 106. For example, the latching ledge 132 may be sloped upward from the pivot point 124 to the button 106 of the lateral arm member 116. In this way, the sloped latching ledge 132 may define a gradual transition from the shorter (e.g., as measured in the direction of first height H1 and second height H2) height of the flexible lateral arm 112 and the longer (e.g., as measured in the direction of first height H1 and second height H2) button 106 of the lateral arm member 116. In some examples, the latching ledge 132 may define an obtuse angle (e.g., an angle greater than 90°) measured relative to flexible lateral arm 112. In cases in which the flexible lateral arm 112 is curved or otherwise not linear, the latching ledge 132 may define an obtuse angle with an axis substantially parallel to the axis along which the first and second widths W1, W2 are measured. In other examples, the latching ledge 132 may otherwise define a sloped transition from the flexible lateral arm 112 to the button 106. For example, the latching ledge 132 may be curved, stepped, or any other appropriate configuration. In some examples, the latching ledge 132 may include more than one face. In such examples, each of the one or more faces may define a sloped transition as described herein. For instance, in some cases, a latching ledge 132 on each side of the button 106 may define a sloped transition from the button 106 to the respective side of the flexible lateral arm 112. In addition, in some examples, the sloped transition comprises a plurality of faces that collectively define a profile (e.g., shape) of the sloped transition.

In examples in which the latching ledge 132 defines a sloped transition from the flexible lateral arm 112 to the button 106, the female component 102 and/or the male component 104 may be less likely to break upon application of a relatively high force upon the buckle assembly 100 in comparison to a buckle assembly in which the lateral arm member 116 does not include such a gradual transition. For example, when a force is applied to the buckle assembly that moves the female component 102 and the male component 104 in generally opposite directions (or moves the male component 104 a direction substantially opposite of the insertion force 154), a lateral arm member 116 with a latching ledge 132 that defines a sloped transition as discussed herein may enable the lock ledge 148 of the female component 102 to gradually engage and exert inward force upon the lateral arm member 116. This may also result in the flexible female component 102 expanding to release the male component 104. In contrast, a buckle assembly without a latching ledge defining a sloped transition as discussed herein may experience a relatively sudden increase in force, and when a force is applied to the buckle assembly that moves the female component and the male component in generally opposite directions, which may cause one or both of the female component or the male component of the buckle assembly to break. Thus, a male component 104 with a latching ledge 132 that defines a sloped transition from the flexible lateral arm 112 to the button 106 may have a longer useful life than other configurations of male components of buckles assemblies. In fact, such a configuration may enable the buckle assembly 100 disclosed herein to be reusable even after application of a relatively high load upon the buckle assembly 100.

Figure 3A:
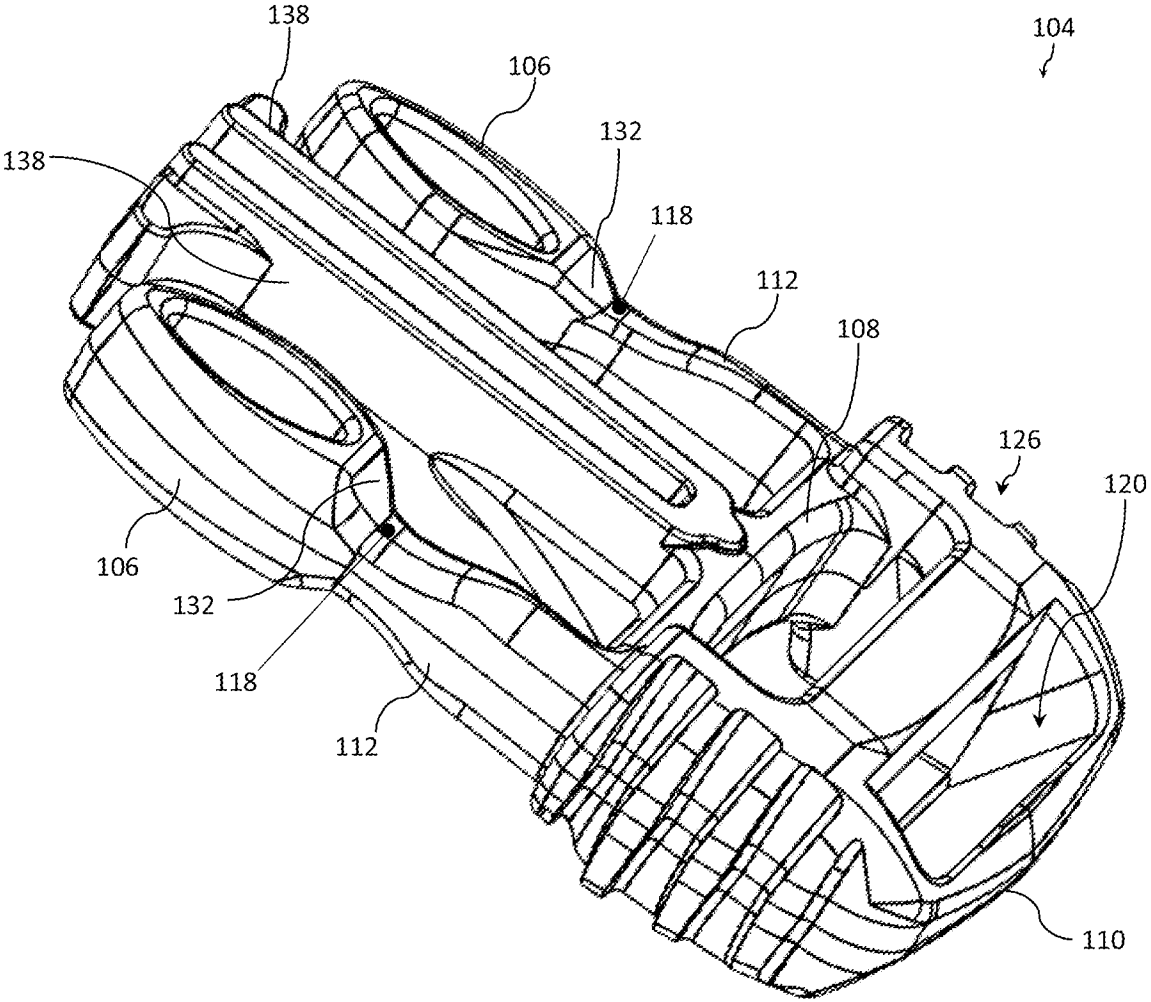
FIG. 3A illustrates another view of a disconnected buckle assembly with a male buckle component in accordance with aspects of this disclosure.
Figure 3B:
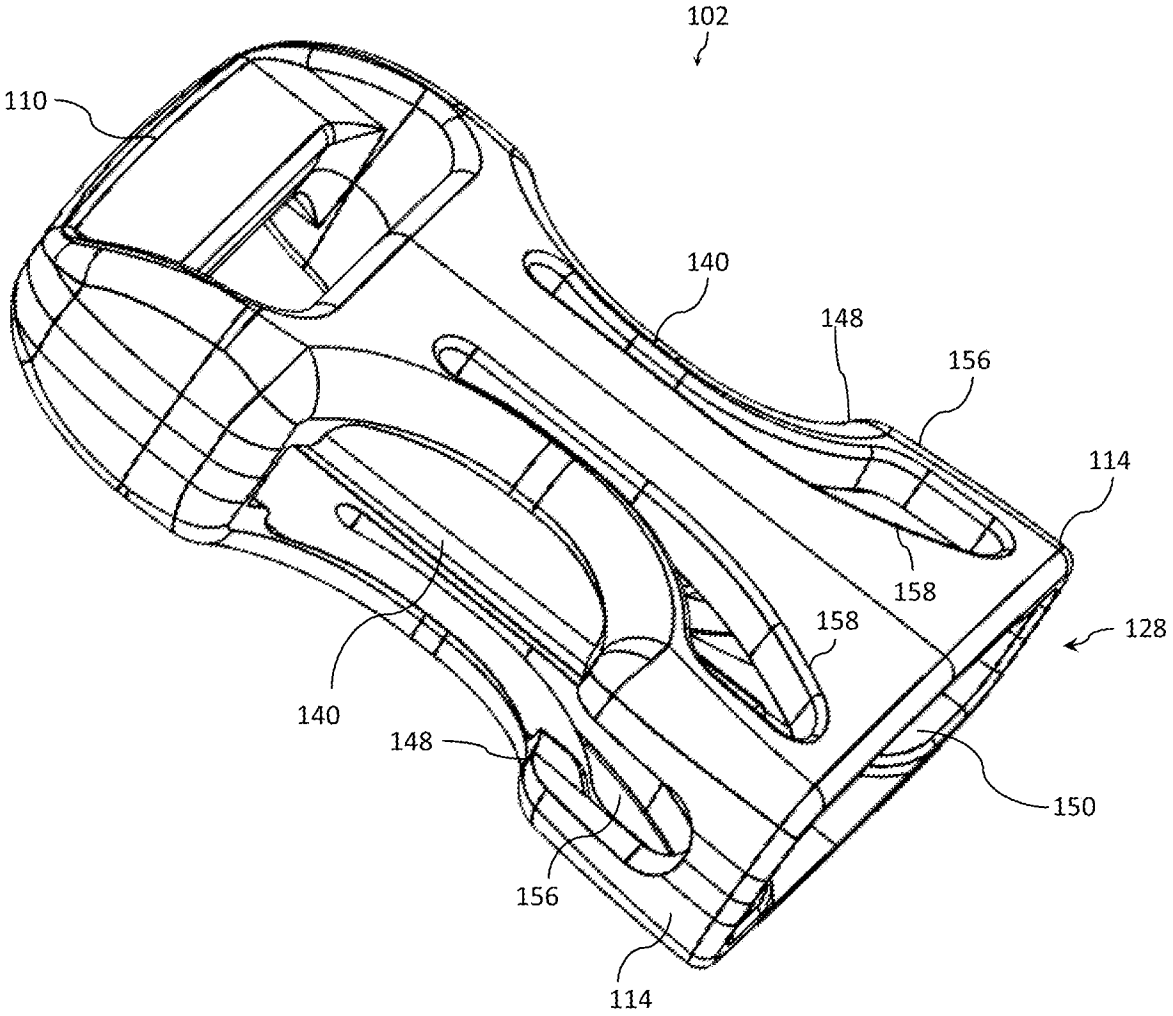
FIG. 3B illustrates a disconnected buckle assembly with a female buckle component in accordance with aspects of this disclosure.
Figure 3C:
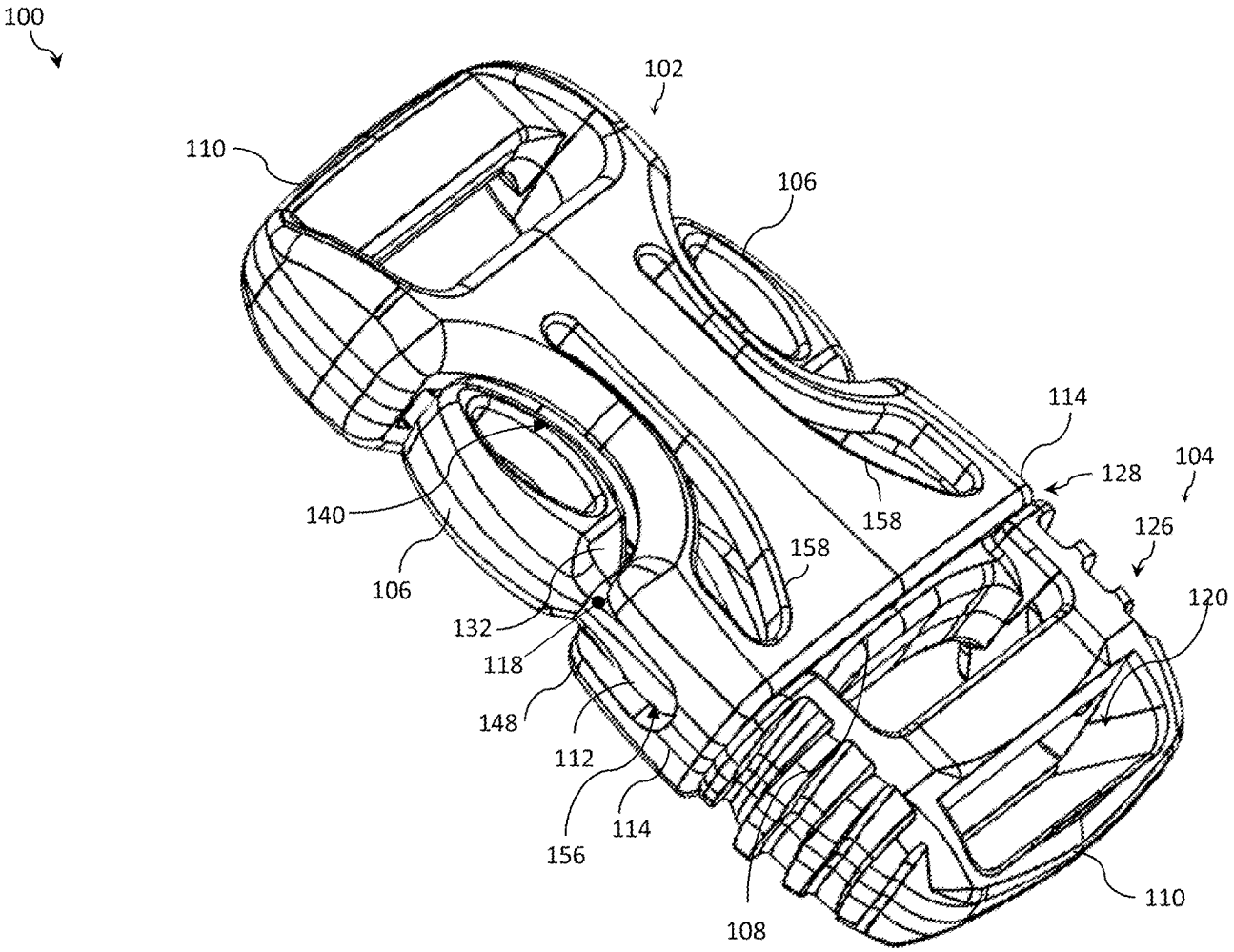
FIG. 3C illustrates a connected buckle assembly with the male buckle component illustrated in FIG. 3A and the female buckle component illustrated in FIG. 3B in accordance with aspects of this disclosure.

FIG. 3A illustrates another view of a disconnected buckle assembly 100 with a male buckle component 104 in accordance with aspects of this disclosure. FIG. 3B illustrates the disconnected buckle assembly 100 with a female buckle component 102 in accordance with aspects of this disclosure. FIG. 3C illustrates a connected buckle assembly 100 with the male buckle component 104 illustrated in FIG. 3A and the female buckle component 102 illustrated in FIG. 3B in accordance with aspects of this disclosure. FIGS. 3A-3C are substantially the same as the buckle assembly 100 described in connection with FIGS. 1A-2B.

While the present device and/or system has been described with reference to certain implementations, it will be understood by those skilled in the art that various changes may be made and equivalents may be substituted without departing from the scope of the present device and/or system. In addition, many modifications may be made to adapt a particular situation or material to the teachings of the present disclosure without departing from its scope. For example, components of disclosed examples may be combined, divided, re-arranged, and/or otherwise modified. Therefore, the present device and/or system are not limited to the particular implementations disclosed. Instead, the present device and/or system will include all implementations falling within the scope of the appended claims, both literally and under the doctrine of equivalents.

The invention claimed is:

1. A male buckle component configured to mate with a female buckle component into a securely connected position, the male buckle component comprising:
- a main body;
- a mating guide beam; and
- one or more lateral arms coupled to the main body and configured to deflect about a pivot point, each of the one or more lateral arms comprising:
  - a flexible lateral arm, and
  - a button, wherein the button is configured to engage the female buckle component via a latching ledge,
    - wherein each of the one or more lateral arms defines a set of opposed sloped transitions from the flexible lateral arm to the button, and
    - wherein the set of opposed slope transitions is configured to release the male buckle from the female buckle component.

2. The male buckle component of claim 1, wherein each of the set of opposed sloped transitions is sloped upward from the pivot point to the button of the flexible lateral arm.

3. The male buckle component of claim 1, wherein each of the set of opposed sloped transitions of the latching ledge defines a gradual transition.

4. The male buckle component of claim 1, wherein each of the set of opposed sloped transitions of the latching ledge defines an obtuse angle relative to a length of the flexible lateral arm.

5. The male buckle component of claim 1, wherein at least one of the set of opposed sloped transitions is linear.

6. The male buckle component of claim 1, wherein at least one of the set of opposed sloped transitions is curved.

7. The male buckle component of claim 1, wherein at least one of the set of opposed sloped transition is stepped.

8. The male buckle component of claim 1, wherein at least one of the set of opposed sloped transitions comprises a plurality of faces that collectively define a profile of the sloped transition.

9. The male buckle component of claim 1, wherein at least one of the set of opposed sloped transitions enables a lock ledge of the female buckle component to gradually engage and exert inward force upon the flexible lateral arm to expand and release the male buckle from the female buckle component.

10. A buckle assembly comprising:
- a male buckle component configured to mate with a female buckle component into a securely connected position, the male buckle component comprising:
  - a main body;
  - a mating guide beam; and one or more lateral arms coupled to the main body and configured to deflect about a pivot point, each of the one or more lateral arms comprising:

a flexible lateral arm, and a button, wherein the button is configured to engage the female buckle component via a latching ledge, wherein each of the one or more lateral arms defines a set of opposed sloped transitions from the flexible lateral arm to the button, and wherein the set of opposed sloped transitions is configured to release the male buckle from the female buckle component; and the female buckle component configured to mate with the male buckle component, the female buckle component comprising:

a housing, wherein a side of the housing defines:

a button aperture configured to secure the button of the male component;

a disengagement aperture proximal to the button aperture; and a pocket configured to receive the male buckle component.

11. The buckle assembly of claim 10, wherein each of the set of opposed sloped transitions is sloped upward from the pivot point to the button of the flexible lateral arm.

12. The buckle assembly of claim 10, wherein each of the set of opposed sloped transition of the latching ledge defines a gradual transition.

13. The buckle assembly of claim 10, wherein each of the set of opposed sloped transitions of the latching ledge defines an obtuse angle relative to a length of the flexible lateral arm.

14. The buckle assembly of claim 10, wherein at least one of the set of opposed sloped transitions is linear.

15. The buckle assembly of claim 10, wherein at least one of the set of opposed sloped transitions is curved.

16. The buckle assembly of claim 10, wherein at least one of the set of opposed sloped transitions is stepped.

17. The buckle assembly of claim 10, wherein at least one of the set of opposed sloped transitions comprises a plurality of faces that collectively define a profile of the sloped transition.

18. The buckle assembly of claim 10, wherein the set opposed sloped transitions enables a lock ledge of the female buckle component to gradually engage and exert inward force upon the flexible lateral arm to expand and release the male buckle from the female buckle component.

19. A buckle assembly comprising:

a male buckle component configured to mate with a female buckle component into a securely connected position, the male buckle component comprising:

a main body;

a mating guide beam; and a pair of lateral arms coupled to the main body and configured to deflect about a pivot point, each of the one or more lateral arms comprising:

a flexible lateral arm, and a button positioned at a distal end of the flexible lateral arm, wherein the button is configured to engage the female buckle component via a latching ledge, wherein each of the pair of lateral arms defines a set of opposed sloped transitions between the flexible lateral arm and the button configured to release the male buckle from the female buckle component by enlarging at least a portion of the female buckle-component; and the female buckle component configured to mate with the male buckle component, the female buckle component comprising:

a housing, wherein a side of the housing defines:

a button aperture configured to secure the button of the male component;

a disengagement aperture proximal to the button aperture; and a pocket configured to receive the male buckle component.

20. The buckle assembly of claim 19, wherein each of the set of opposed sloped transitions is sloped upward from the pivot point to the button of the flexible lateral arm.

* * * * *